US006611578B2

(12) United States Patent
Snoeren et al.

(10) Patent No.: US 6,611,578 B2
(45) Date of Patent: Aug. 26, 2003

(54) X-RAY EXAMINATION APPARATUS

(75) Inventors: Rudolph Maria Snoeren, Eindhoven (NL); Johannes Catharina Antonius Op De Beek, Eindhoven (NL); Matthijs Adriaansz, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/028,119

(22) Filed: Dec. 21, 2001

(65) Prior Publication Data

US 2002/0118791 A1 Aug. 29, 2002

(30) Foreign Application Priority Data

Dec. 27, 2000 (EP) ..... 00203824

(51) Int. Cl.[7] ..... G21K 3/00
(52) U.S. Cl. ..... 378/158; 378/156
(58) Field of Search ..... 378/158, 156, 378/98.7, 19, 157

(56) References Cited

U.S. PATENT DOCUMENTS 5,602,394 A * 2/1997 Dombrowski et al. . 250/339.02
5,625,665 A * 4/1997 Fokkink et al. ..... 378/156
5,666,396 A 9/1997 Linders et al. ..... 378/156
5,923,724 A * 7/1999 Soukal ..... 378/156

* cited by examiner

*Primary Examiner*—Drew A. Dunn
*Assistant Examiner*—Irakli Kiknadze
(74) *Attorney, Agent, or Firm*—John Vodopia

(57) ABSTRACT

The present invention provides an X-ray examination apparatus, comprising an X-ray source, an X-ray detector, a filter arranged between said source and said detector, said filter comprising an array of filter elements having X-ray absorbtivities that can be adjusted by means of control voltages, a control circuit for supplying said control voltages to said filter elements, and an object support arranged between said filter and said detector, said station being adapted to support an object to be exposed to X-ray radiation emanating from said source, the transmitted X-ray radiation being detected by said detector, said control circuit being adapted to supply said control voltages in single-sequence fashion to groups of adjacent filter elements.

7 Claims, 2 Drawing Sheets

X-RAY EXAMINATION APPARATUS

FIELD OF THE INVENTION

This invention is relative to an X-ray examination apparatus, comprising an X-ray source, an X-ray detector, a filter arranged between said source and said detector, said filter comprising an array of filter elements having X-ray absorbtivities that can be adjusted by means of control voltages, a control circuit for supplying said control voltages to said filter elements, and an object support arranged between said filter and said detector, said station being adapted to support an object to be exposed to X-ray radiation emanating from said source, the transmitted X-ray radiation being detected by said detector.

BACKGROUND OF THE INVENTION

Such an apparatus is known from e.g. U.S. Pat. No. 5,625,665.

This prior art reference is relative to a dynamic beam attenuator, which is a pixelwise adjustable X-ray filter, by means of which parts of a patient to be examined can be effectively covered so that these parts are not unnecessarily exposed to X-ray radiation. This defines a Region of Interest or ROI. Thus the radiation dose to which the patient is exposed is decreased and the influence of scattered radiation is diminished. This prior art principle is also applied in so-called slit-scanning. A small slit is formed by the dynamic beam attenuator and is moved effectively over the patient in order to form a total X-ray picture of the patient. Outside the slit radiation of a different spectral composition is transmitted. If desired, more slits can be used simultaneously in order to decrease the effective scanning time, which of course goes at the expense of the reduction of scattered radiation.

Due to the reduction of scattered radiation due to slit-scanning the contrast in the picture as finally obtained improves.

Of course the effective electrical power load imposed on the X-ray source is higher in the case of slit-scanning. A further disadvantage may be residing in the fact that the discrete slits will be noticeable in the final picture.

SUMMARY OF THE INVENTION

It is a purpose of the invention to provide an apparatus that allows making an X-ray picture of an object, e.g. a patient, within a time frame of about one second.

It is a further purpose of the invention to design an apparatus of the kind set forth in the way such that the influence of scattered radiation is reduced.

Generally, the X-ray examination apparatus comprises said control circuit being adapted to supply said control voltages in single-sequence fashion to groups of adjacent filter elements.

It should be noted that this invention is not limited to the technique according the mentioned prior art reference U.S. Pat. No. 5,625,665, in which the filter elements each include a capillary tube communicating with a reservoir with an X-ray absorbing liquid, the electrical control taking place by controlling the capillary properties of said capillary tubes.

The apparatus according to the invention can advantageously be designed such that said groups are evenly and regularly distributed over the filter.

The basic principles according to the invention described herein above can be implemented in several technical ways.

In a practical mechanical embodiment each filter element comprises an X-ray absorbing element coupled with an actuator controlled by a respective control voltage, thus controlling the effective X-ray absorbtivity of said filter element.

This embodiment can be designed such that said X-ray absorbing element comprises a heavy element, e.g. lead.

The mechanical actuator may be adapted to cause the associated filter element to follow a specific linear or curved path.

In an alternative embodiment the filter element comprises a liquid crystal element controlled by a respective control voltage for controlling the effective X-ray absorbtivity of said filter.

In order to ensure sufficient X-ray intensity attenuation the liquid crystal element should have sufficient thickness or the filter element may be composed of a plurality of liquid crystal elements.

A preferred embodiment is embodied such that each filter element comprises a capillary tube connected to a reservoir for X-ray absorbing liquid, the inner surface of said capillary tube at least partly being coated with an electrically conductive layer connected with said control circuit for receiving a respective control voltage for adjusting the amount of X-ray absorbing liquid present in said capillary tube thus controlling the effective X-ray absorbtivity of said filter element. The filter structure is known per se from U.S. Pat. No. 5,625,665. The novel feature according to the invention is residing in the specific mono-cyclic control such that spot-scanning occurs.

With a view to designing the apparatus according to the invention in a way such that an extremely high signal to noise ratio is achieved a preferred embodiment further comprises a signal processing assembly receiving detector signals from said detector, said detector signals being group-wise arranged in accord with the supply of said control voltages to said groups of adjacent filter elements, said groups of detector signals being supplied to a memory means, said signal processing assembly being adapted to reconstruct an image by comparing pixel-wise said respective groups of detector signals stored in said memory means and using only every pixel value which is larger than the signal values of the corresponding pixel of every other group.

These and other aspects of the invention will be apparent and elucidated with reference to the embodiments described hereinafter.

DETAILED DESCRIPTION OF THE PREFERRED EMBODIMENTS

Figure 1:
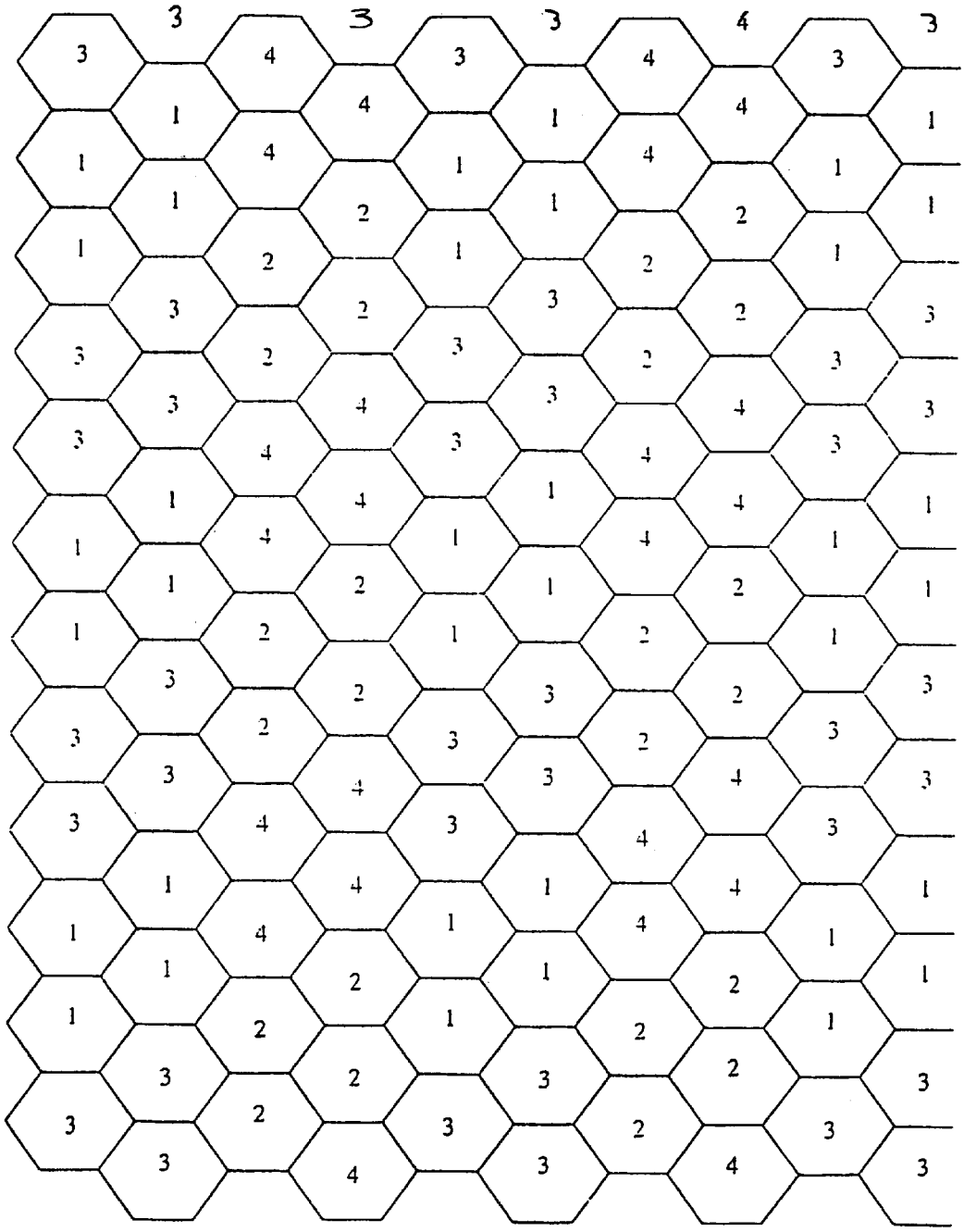
FIGS. 1 and 2 show honeycomb-filter structures including regular arrays of hexagonal filter elements embodied as electrically controllable capillary tubes in accord with U.S. Pat. No. 5,625,665.
Figure 2:
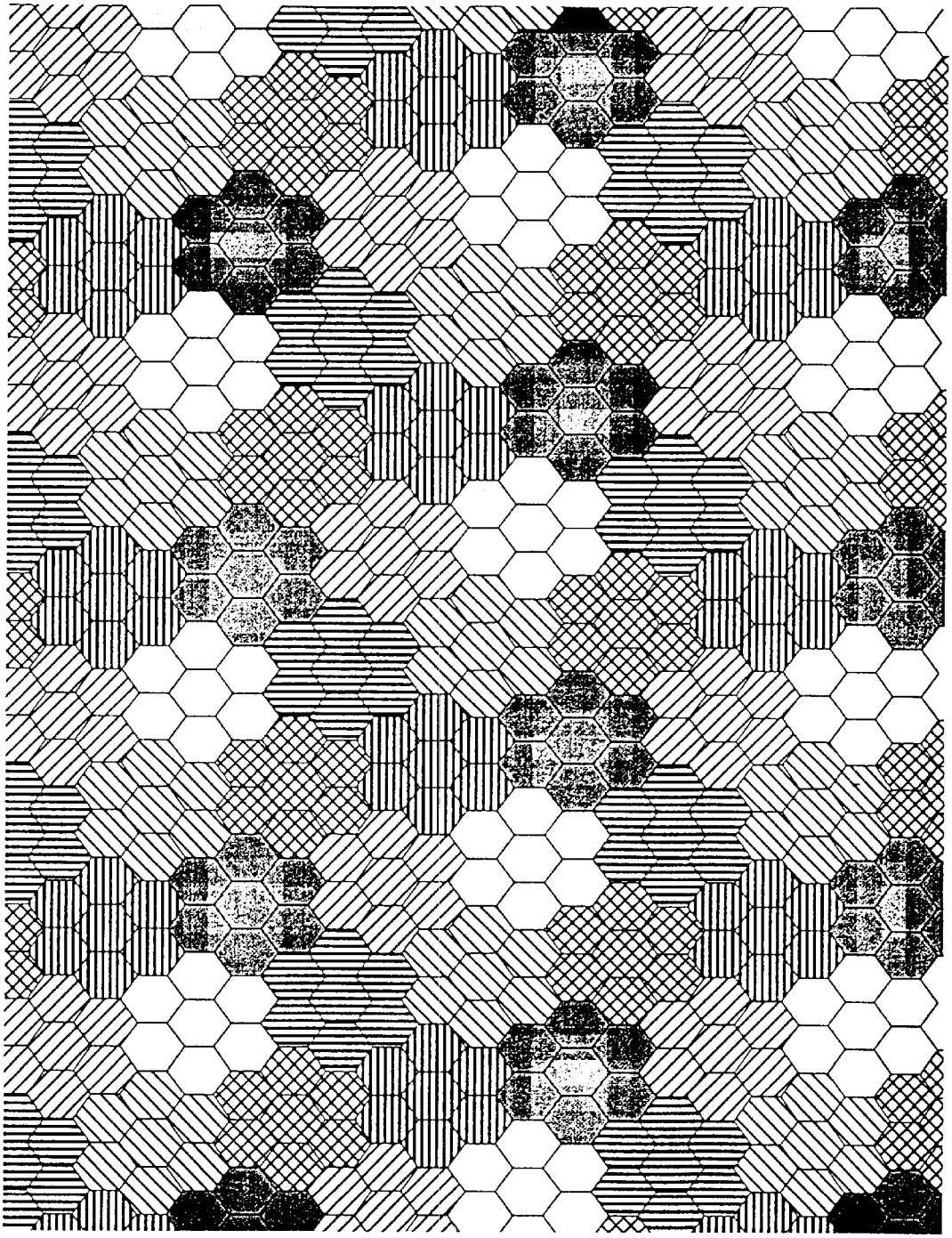

FIGS. 1 and 2 show respective end views of honeycomb-filter structures for limiting the dynamic range of an X-ray image formed by an X-ray detector by exposure of an object, such as a patient to be examined, to X-rays.

The hexagonal cells are formed of capillary tubes, the one ends of which communicate with a reservoir containing an X-ray absorbing liquid. The adhesion of X-ray absorbing liquid to the inner sides of the capillary tubes can be adjusted by means of electrical voltages applied to the respective electrically conductive layers provided on the inner sides of the capillary tubes.

In accord with the invention groups of adjacent tubes are in mono-cyclic fashion energized in a way such that in the region of interest or ROI the object to be examined is exposed to X-ray radiation transmitted through the successive groups of filter elements energized in a way such that the X-ray absorbing liquid is during exposure temporarily removed from the capillary tubes in question.

FIG. 1 indicates with the respective numerals 1, 2, 3 and 4 the single cycle of energizing the respective capillary tubes. In this case the cycle consists of four phases, viz. the energization of the groups indicated with 1, 2, 3 and 4, successively.

FIG. 2 shows an alternative, in which the successive phases of the cycle are indicated with seven different hatchings instead of the numerals used in FIG. 1, clearly showing that each full exposure cycle consists of seven phases.

In analogy to the prior art technique of continuous slit scanning with a moving narrow slit the discrete spot scanning apparatus according to the invention can be used to generate one or more fan-like X-ray beams. The advantage of scatter reduction achieved in this way can be enhanced by generating a moving spot pattern on basis of the principles of the present invention. A scatter component is further reduced while the total surface of the exposing spots comprised of a plurality of filter elements can be equally large as the total surface of the slit pattern of a prior art slit scanning device. Spot transmission times can be adapted individually such that the dynamic range of the absorbed signal is reduced thus resulting in a better deployment of the X-ray detector's dynamic range and a considerable reduction of the X-ray dose to which the object is exposed. Specifically in the case of medical application this is important in view of the desired limitation of the dose to which a patient is exposed.

The adjustment of one phase of the sequence of the dynamic beam attenuator takes about 200 ms. The exposure time takes about 10–100 ms. In case of a number of phases of four in accord with the FIG. 1 embodiment the entire exposure time will be a maximum of $(3\times200)+4\times100)=1000$ ms or 1 s. This result shows that even in the worst case exposure time of 100 ms the purpose of the invention to make a picture within a time period of about 1 s is realized.

What is claimed is:

1. An X-ray examination apparatus, comprising:

an X-ray source, an X-ray detector, a filter arranged between said source and said detector, said filter comprising an array of filter elements having X-ray absorbtivities that can be adjusted by means of control voltages, a control circuit for supplying said control voltages to said filter elements, an object support arranged between said filter and said detector, said station being adapted to support an object to be exposed to X-ray radiation emanating from said source, the transmitted X-ray radiation being detected by said detector, and a signal processing assembly receiving detector signals from said X-ray detector, said detector signals being group-wise arranged in accord with the supply of said control voltages to groups of adjacent filter elements, said control circuit being adapted to supply said control voltages in single-sequence fashion to said groups of adjacent filter elements.

2. The apparatus as claimed in claim 1, in which said groups are evenly and regularly distributed over the filter.

3. The apparatus as claimed in claim 1, in which each filter element comprises an X-ray absorbing element coupled with an actuator controlled by a respective control voltage, thus controlling the effective X-ray absorbtivity of said filter element.

4. The apparatus as claimed in claim 3, in which said X-ray absorbing element comprises a heavy element.

5. The apparatus as claimed in claim 1, in which filter element comprises a liquid crystal element controlled by a respective control voltage for controlling the effective X-ray absorbtivity of said filter.

6. The apparatus as claimed in claim 1, in which each filter element comprises a capillary tube connected to a reservoir for X-ray absorbing liquid, the inner surface of said capillary tube at least partly being coated with an electrically conductive layer connected with said control circuit for receiving a respective control voltage for adjusting the amount of X-ray absorbing liquid present in said capillary tube thus controlling the effective X-ray absorbtivity of said filter element.

7. The apparatus as claimed in claim 1, wherein said groups of detector signals being supplied to a memory means, said signal processing assembly being adapted to reconstruct an image by comparing pixel-wise said respective groups of detector signals stored in said memory means and using only every pixel value which is larger than the signal values of the corresponding pixel of every other group.

* * * * *